US010766721B2

(12) United States Patent
Inoue

(10) Patent No.: US 10,766,721 B2
(45) Date of Patent: Sep. 8, 2020

(54) SHEET FEEDING DEVICE CAPABLE OF USING LONG SHEETS, METHOD OF CONTROLLING SHEET FEEDING DEVICE, AND IMAGE FORMING SYSTEM

(71) Applicant: CANON KABUSHIKI KAISHA, Tokyo (JP)

(72) Inventor: Seita Inoue, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/980,921

(22) Filed: May 16, 2018

(65) Prior Publication Data

US 2018/0334340 A1 Nov. 22, 2018

(30) Foreign Application Priority Data

May 19, 2017 (JP) ..... 2017-099931

(51) Int. Cl.

| | |
|---|---|
| ***B65H 1/28*** | (2006.01) |
| ***B65H 1/14*** | (2006.01) |
| ***B65H 1/26*** | (2006.01) |
| ***B65H 7/02*** | (2006.01) |
| *B65H 1/18* | (2006.01) |
| *B65H 39/043* | (2006.01) |

(52) U.S. Cl.

CPC ..... *B65H 1/14* (2013.01); *B65H 1/266* (2013.01); *B65H 7/02* (2013.01); *B65H 1/18* (2013.01); *B65H 1/28* (2013.01); *B65H 39/043* (2013.01); *B65H 2405/11164* (2013.01); *B65H 2405/15* (2013.01); *B65H 2405/3311* (2013.01); *B65H 2511/11* (2013.01); *B65H 2511/15* (2013.01); *B65H 2511/414* (2013.01); *B65H 2701/528* (2013.01); *B65H 2801/06* (2013.01)

(58) Field of Classification Search

CPC . B65H 1/28; B65H 1/18; B65H 1/266; B65H 39/043; B65H 2405/3311; B65H 2701/528

See application file for complete search history.

(56) References Cited

U.S. PATENT DOCUMENTS

| | | | | |
|---|---|---|---|---|
| 6,123,329 A * | 9/2000 | Sato | ..... | B65H 1/14 271/145 |
| 6,603,952 B2 * | 8/2003 | Hoene | ..... | B65H 1/14 271/157 |
| 8,439,343 B2 * | 5/2013 | Yamaguchi | ..... | B65H 1/14 271/162 |

(Continued)

*Primary Examiner* — Howard J Sanders

(74) *Attorney, Agent, or Firm* — Rossi, Kimms & McDowell LLP

(57) ABSTRACT

A sheet feeding device capable of improving user's convenience even in a case where non-long sheets and long sheets are switchingly used. A sheet storage opened and closed for storing sheets to be used for image formation. A deck supply path feeds sheets from the sheet storage. A first and a second lift plate are provided in the sheet storage, side by side, in a sheet feeding direction. The first and second lift plates can be lifted up and down by a lift mechanism. A CPU determines whether or not an operation concerning storing long sheets in the sheet storage has been performed. When it is determined that the operation has been performed, the CPU controls the lift mechanism to cause the levels of the first and second lift plates to match each other.

16 Claims, 5 Drawing Sheets

(56) References Cited

U.S. PATENT DOCUMENTS

| | | | | |
|---|---|---|---|---|
| 9,359,157 | B2 | 6/2016 | Niikura et al. | |
| 2015/0130124 | A1* | 5/2015 | Muto | B65H 7/04<br>271/9.03 |
| 2017/0203930 | A1* | 7/2017 | Yamauchi | G03G 15/6511 |

* cited by examiner

SHEET FEEDING DEVICE CAPABLE OF USING LONG SHEETS, METHOD OF CONTROLLING SHEET FEEDING DEVICE, AND IMAGE FORMING SYSTEM

BACKGROUND OF THE INVENTION

Field of the Invention

The present invention relates to a sheet feeding device capable of feeding long sheets to an image forming apparatus, a method of controlling the sheet feeding device, and an image forming system including the sheet feeding device.

Description of the Related Art

In recent years, as printed media diversify, there is an increasing demand for an image forming apparatus that is capable of continuously performing image formation on a large number of sheets having a longer length in a sheet feeding direction than a predetermined length (for example, the length of A3 sheets) (hereinafter referred to as "long sheets"). Examples of a sheet feeding device applied to such an image forming apparatus include one disclosed in U.S. Pat. No. 9,359,157. The sheet feeding device disclosed in U.S. Pat. No. 9,359,157 is configured such that so as to accommodate regular sheets (non-long sheets) which are not long sheets, a sheet storage can be drawn out toward the near side. Further, the sheet feeding device is configured such that so as to accommodate long sheets, an extension plate is fixed to a bottom plate of the sheet storage, and long sheets are received therein from upstream in the sheet feeding direction. In the sheet feeding device configured to fix the extension plate for long sheets to the bottom plate, as described above, the operation of drawing out the sheet storage is locked as long as the extension plate is fixed to the bottom plate, so as to provide a prevention measure against breakage of the device due to an erroneous operation by a user.

In the above-described related art, however, although breakage of the device can be prevented, in a case where images are formed using long sheets after images are formed using non-long sheets, it is necessary to fix the extension plate to the bottom plate to extend the same. Further, in a case where images are formed using non-long sheets after images are formed using long sheets, it is necessary to remove the extension plate fixed for temporary use. This causes a problem that user's convenience is degraded in a case where the frequency of switching between non-long sheets and long sheets is high.

SUMMARY OF THE INVENTION

The present invention provides a sheet feeding device that is capable of improving user's convenience even in a case where non-long sheets and long sheets are switchingly used, a method of controlling the sheet feeding device, and an image forming system.

In a first aspect of the present invention, there is provided a sheet feeding device comprising a storage configured to be openable and closable, and to store sheets to be used for image formation, a feed unit configured to feed sheets from the storage, a first lift plate and a second lift plate, provided in the storage, side by side, in a sheet feeding direction, and each configured to be capable of being lifted up and down, a lifter configured to lift up and down the first lift plate and the second lift plate, and a controller configured to determine whether or not an operation has been performed concerning storing of long sheets longer than a predetermined length in the sheet feeding direction, in the storage, and to control the lifter, in a case where it is determined that the operation has been performed, to cause a level of the first lift plate in a height direction and a level of the second lift plate in the height direction to match each other.

In a second aspect of the present invention, there is provided an image forming system including a sheet feeding device, and an image forming apparatus that forms images on sheets fed from the sheet feeding device, wherein the sheet feeding device comprises a storage configured to be openable and closable, and to store sheets to be used for image formation, a feed unit configured to feed sheets from the storage, a first lift plate and a second lift plate, provided in the storage, side by side, in a sheet feeding direction, and each configured to be capable of being lifted up and down, a lifter configured to lift up and down the first lift plate and the second lift plate, and a controller configured to determine whether or not an operation has been performed concerning storing of long sheets longer than a predetermined length in the sheet feeding direction, in the storage, and to control the lifter, in a case where it is determined that the operation has been performed, to cause a level of the first lift plate in a height direction and a level of the second lift plate in the height direction to match each other.

In a third aspect of the present invention, there is provided a method of controlling a sheet feeding device including a storage configured to be openable and closable, and to store sheets to be used for image formation, a feed unit configured to feed sheets from the storage, a first lift plate and a second lift plate, provided in the storage, side by side, in a sheet feeding direction, and each configured to be capable of being lifted up and down, and a lifter configured to lift up and down the first lift plate and the second lift plate, the method comprising determining whether or not an operation has been performed concerning storing of long sheets longer than a predetermined length in the sheet feeding direction, in the storage, and controlling the lifter, in a case where it is determined that the operation has been performed, to cause a level of the first lift plate in a height direction and a level of the second lift plate in the height direction to match each other.

According to the present invention, in a case where long sheets are expected to be used, preparation for storing the long sheets is performed by making the respective levels of a first lift plate and a second lift plate equal to each other. This makes it possible to improve the user-friendliness of the sheet feeding device which switchingly uses non-long sheets and long sheets.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
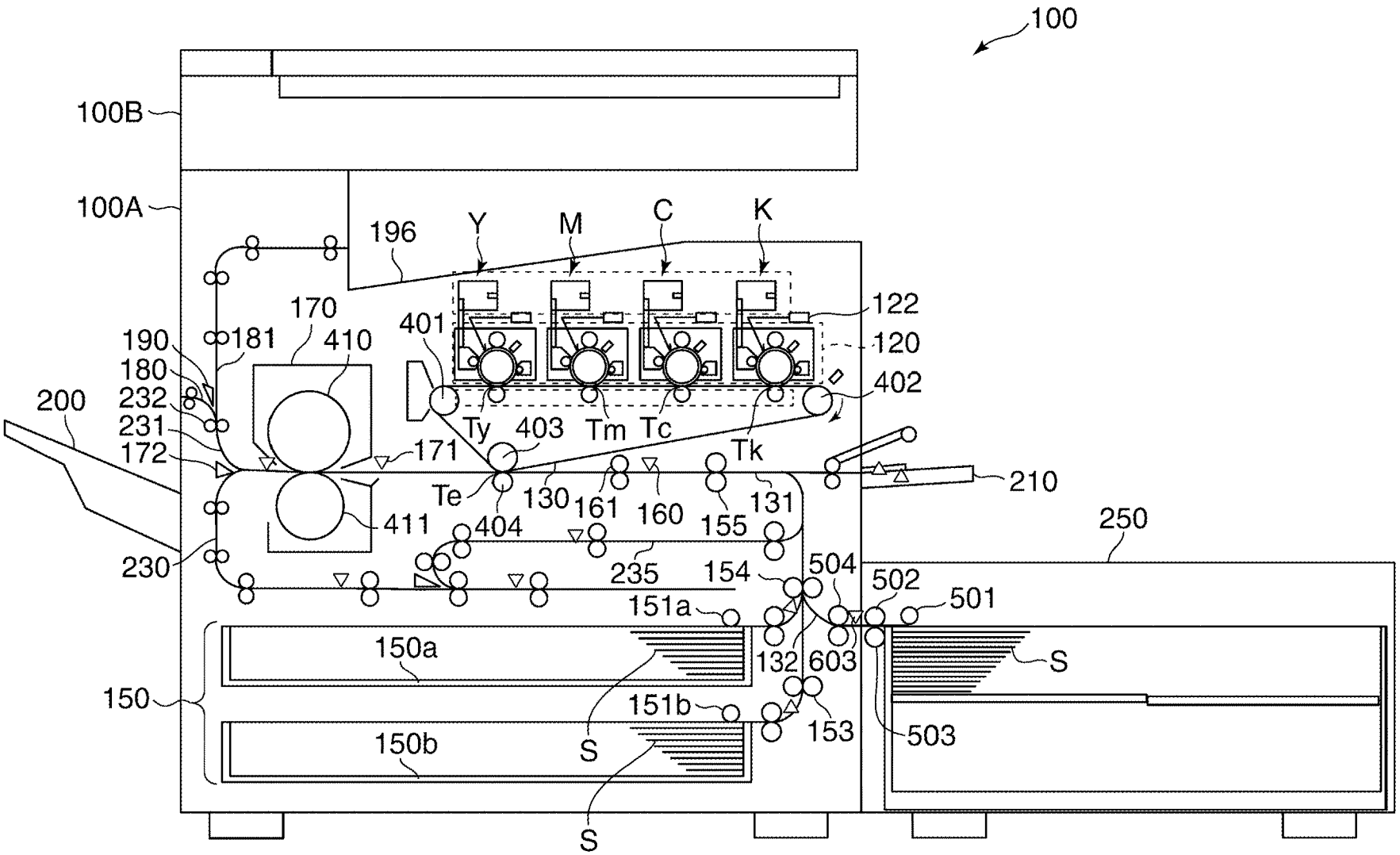
FIG. 1 is a schematic cross-sectional view of an image forming apparatus including a sheet feeding device according to an embodiment of the invention.

FIG. 1 is a schematic cross-sectional view of an image forming apparatus including a sheet feeding device according to an embodiment of the invention. Referring to FIG. 1, the image forming apparatus 100 includes an image forming apparatus body (hereinafter referred to as the "printer") 100A, and an image reading device (hereinafter referred to as the "image reader") 100B.

The image reader 100B reads an original image placed e.g. on a platen glass, not shown, and transmits image data of the original image as video signals to scanner units, described hereinafter, of the printer 100A.

The printer 100A includes a process unit 120 for forming color images.

The process unit 120 includes a plurality of image forming stations Y, M, C, and K arranged side by side in a horizontal direction. The image forming stations Y to K form images of yellow (Y), magenta (M), cyan (C), and black (K), respectively. The image forming stations Y to K have the same configuration, and include photosensitive drums as photosensitive members which are rotatably supported on rotating shafts, not shown, respectively. The photosensitive drums each function as an image bearing member. In opposed relation to outer peripheral surfaces of the respective photosensitive drums, there are arranged primary charging devices, the scanner units 122, reflection mirrors, developing devices, and cleaners, respectively. Each developing device is connected to an associated one of toner replenishing sections.

An intermediate transfer belt 130 in the form of an endless belt is arranged such that it is in sliding contact with the respective photosensitive drums of the image forming stations Y to K. Similar to each photosensitive drum, the intermediate transfer belt 130 functions as an image bearing member, and is rotatably stretched by a drive roller 401, a tension roller 402, and a secondary transfer opposed roller 403, for example. A secondary transfer roller 404 is disposed in opposed relation to the secondary transfer opposed roller 403. A contact portion of the secondary transfer roller 404 and the secondary transfer opposed roller 403 forms a secondary transfer section Te.

Four primary transfer rollers are disposed in opposed relation to the four photosensitive drums via the intermediate transfer belt 130, respectively. Respective contact portions of the primary transfer rollers and the photosensitive drums form primary transfer sections Ty to Tk. Toner images of the four colors to be transferred to the same sheet are sequentially formed on associated ones of the four photosensitive drums.

Arranged below the intermediate transfer belt 130 are a sheet storage section 150 for storing sheets S and a sheet conveying section 305 (see FIG. 3) for conveying each sheet S to the secondary transfer section Te and discharging the same out of the printer 100A. The sheet storage section 150 is comprised of an upper cassette 150*a* and a lower cassette 150*b*. The upper cassette 150*a* and the lower cassette 150*b* are capable of stacking a large number of sheets S therein. Regular sheets e.g. of the same size or different sizes are stored in the upper and lower cassettes 150*a* and 150*b*. In addition to the upper cassette 150*a* and the lower cassette 150*b*, there are provided a sheet feeding deck (sheet feeding device) 250 and a manual feed tray 210.

The sheet feeding deck 250 is disposed on the right side of the printer 100A as viewed in FIG. 1, and is capable of stacking not only sheets of regular sizes, such as the A3 size and the A4 size, but also a large number of long sheets which are longer in length in a sheet feeding direction than the regular sheets. A user uses the sheet feeding deck 250 in a case where images are formed on sheets other than the regular sheets, or in a case where images are formed on sheets of a size different from the size of sheets which have already been stored in the upper cassette 150*a* and the lower cassette 150*b*, or in a case where images are formed on a large number of sheets. The sheet feeding deck 250 will be described in detail hereinafter. Note that the manual feed tray 210 is suitably used in a case where images are formed on a relatively small number, e.g. approximately several tens, of sheets which are temporarily used.

A conveying path of the sheet conveying section 305 includes a supply path 131 and a discharge path 231. The supply path 131 is a conveying path along which conveys sheets S are conveyed from the upper cassette 150*a*, the lower cassette 150*b*, the sheet feeding deck 250, or the manual feed tray 210, to the secondary transfer section Te. The discharge path 231 is a conveying path along which sheets S having been subjected to image formation are conveyed to the outside of the image forming apparatus.

The supply path 131 is provided with pickup rollers 151*a* and 151*b* and conveying roller pairs 154 and 153, which are associated with the upper and lower cassettes 150*a* and 150*b*, respectively, as well as a conveying roller pair 155 and a registration roller 161. A registration sensor 160 is disposed at a location upstream of the registration roller 161. The registration sensor 160 detects a sheet being conveyed so as to determine a timing at which the sheet reaches the registration roller 161. The registration sensor 160 also functions as a size detecting section for detecting the size of the sheet S being conveyed. That is, the registration sensor 160 outputs signals on respective occasions of detection of the leading edge and the trailing edge of the same sheet S. A CPU 301 as a controller, referred to hereinafter, detects the sheet size of the sheet S in the conveying direction of the sheet S using the output signals from the registration sensor 160.

The printer 100A and the sheet feeding deck 250 are connected by a deck supply path 132. The deck supply path 132 is connected to the supply path 131 on the upstream side of the conveying roller pair 154. Each of the sheets S stored in the sheet feeding deck 250 is conveyed into the supply path 131 via the deck supply path 132.

On the other hand, a fixing device 170 including a heating roller 410 and a pressing roller 411 is provided in an intermediate portion of the discharge path 231, and an inversion path 230 branches from a portion of the discharge path 231 downstream of the fixing device 170. Further, a double-sided conveying path 235 is connected to the inversion path 230. At a connection portion between the discharge path 231 and the inversion path 230, there is disposed an inversion flapper 172. According to the conveying destination of a sheet S discharged from the fixing device 170, the inversion flapper 172 guides the sheet S either toward an upper discharge path 181 and a lower discharge path 180 or into the inversion path 230.

The discharge path 231 is bifurcated into the upper discharge path 181 and the lower discharge path 180 at a location downstream of the connection portion between the discharge path 231 and the inversion path 230. At the branching point, there is disposed an inversion flapper 190. According to the conveying destination of a sheet S, the inversion flapper 190 guides the sheet S into the upper discharge path 181 or the lower discharge path 180. The upper discharge path 181 is a conveying path along which the sheet S is conveyed to be discharged onto an upper discharge tray 196. Further, the lower discharge path 180 is a conveying path along which the sheet S is conveyed to be discharged onto a lower discharge tray 200. The discharge path 231 is provided with a conveying roller pair 232 at a location downstream of a connection portion between the discharge path 231 and the inversion path 230, and each of the inversion path 230, the double-sided conveying path 235, the upper discharge path 181, and the lower discharge path 180 is also provided with a conveying roller pair or a discharge roller pair.

Next, a description will be given of the configuration of the sheet feeding deck 250.

Figure 2:
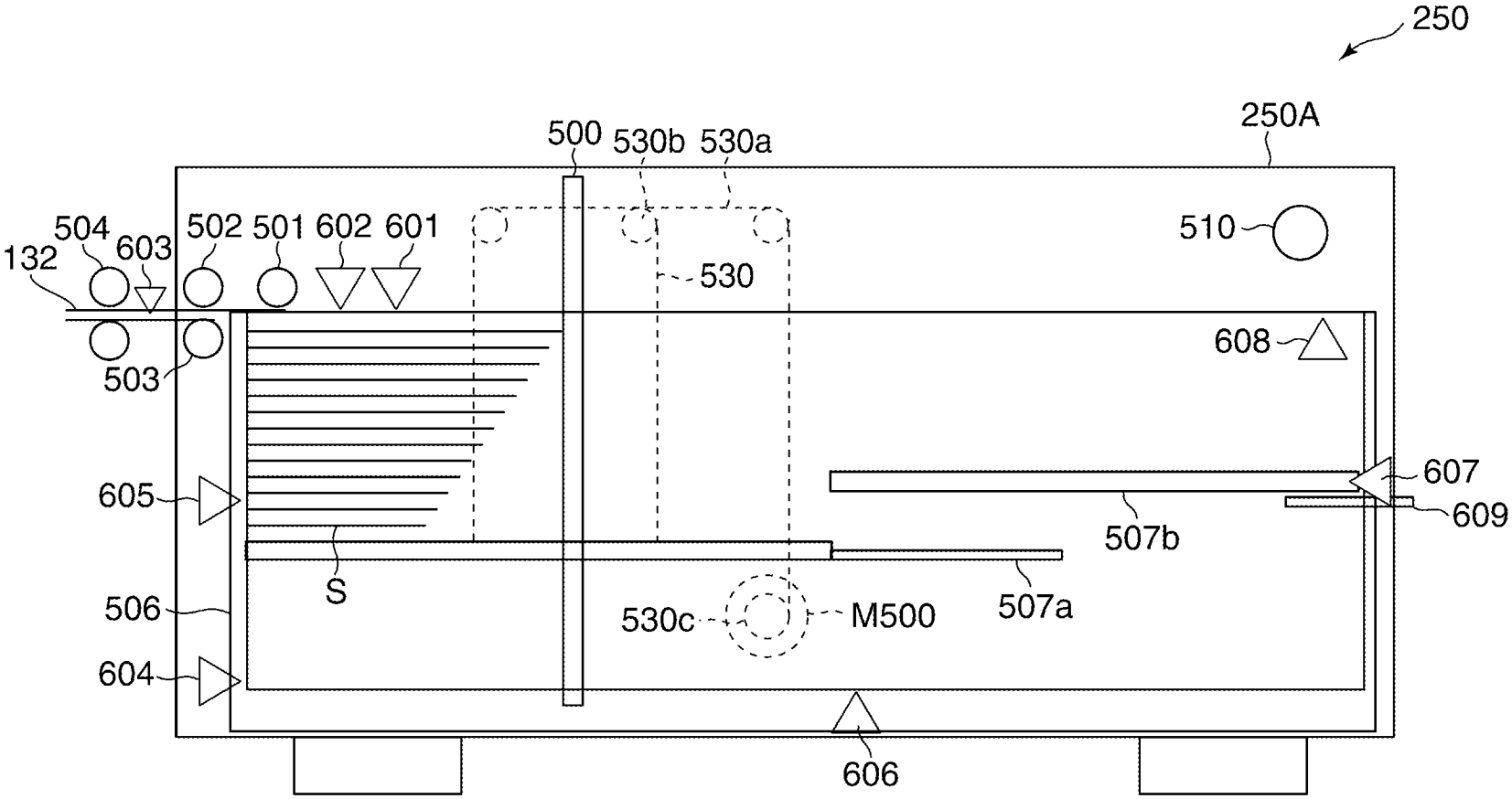
FIG. 2 is an enlarged cross-sectional view of the sheet feeding device appearing in FIG. 1.

FIG. 2 is a cross-sectional view of the sheet feeding deck (sheet feeding device) of the image forming apparatus shown in FIG. 1. Referring to FIG. 2, the sheet feeding deck 250 includes a casing 250A, a box-like sheet storage 506 for storing a large number of sheets S, two lift plates 507*a* and 507*b* which are mounted in the sheet storage 506 in a manner such that they can be lifted up and down, and the deck supply path 132 for feeding sheets S to the printer 100A. The sheet storage 506 is configured to be capable of being drawn out from and pushed into the casing 250A.

The lift plate 507*a* and the lift plate 507*b* are arranged side by side in the sheet feeding direction in the sheet storage 506. The lift plate 507*a* covers e.g. the left half of the sheet storage 506, and is configured to be capable of being lifted up and down by a lift mechanism (lifter) 530. The lift mechanism 530 is an elevator that lifts up and down the lift plate 507*a*, and includes a wire 530*a* for suspending and supporting the lift plate 507*a*, a plurality of pulleys 530*b* around which the wire 530*a* extends, and a wire pulley 530*c* to which one end of the wire 530*a* is fixed. The wire pulley 530*c* is driven for rotation by a lifter motor M500, and lifts up and down the lift plate 507*a*.

The lift plate 507*b* has a length approximately half the length of the sheet storage 506 in the sheet feeding direction. The lift plate 507*b* is lifted up and down within a predetermined range in accordance with the lifting (up and down motion) of the lift plate 507*a*. More specifically, the lifting down motion of the lift plate 507*b* is limited by a mechanical stopper 609 provided at a side of the sheet storage 506, which is close to the lift plate 507*b*, and the lift plate 507*b* is configured to be capable of being lifted up and down above the mechanical stopper 609. In other words, the mechanical stopper 609 serves as a restriction member configured to cause the lift plate 507*b* to stay at a long sheet lower limit position (predetermined position), referred to hereinafter. The lift range of the lift plate 507*b* is smaller than the lift range of the lift plate 507*a*. The lift plate 507*b* functions as an extension lift plate for extending the length of the lift plate 507*a*.

A lifting down limit position (long sheet lower limit position) of the lift plate 507*b* is a lift plate position where the sheet feeding deck 250 can stack the maximum number of long sheets, for example, a position where the sheet feeding deck 250 can stack 1000 long sheets. The bottom dead center of the lift plate 507*b* is the home position (HP) of the lift plate 507*b*, the HP is provided with an extension lifter HP sensor 607 at the side of the sheet storage 506, which is close to the lift plate 507*b*.

The extension lifter HP sensor 607 determines whether or not the lift plate 507*b* is at the HP. If the lift plate 507*b* is at the HP, the extension lifter HP sensor 607 is turned on, whereas if the lift plate 507*b* is not at the HP, the extension lifter HP sensor 607 is turned off.

Note that if the lift plate 507*b* is configured to be capable of being lifted down below the HP, there is a fear that a user stacks 1000 or more long sheets. In such a case, a motor having a higher power is required. Therefore, the mechanical stopper 609 is provided to limit the lifting down of the lift plate 507. The HP of the lift plate 507*b* is defined by taking into account the strength of the lift plates 507*a* and 507*b*, the strength of the sheet storage 506, and the capability of the lift mechanism 530 (power of the motor). However, the lifting down limit position of the lift plate 507*b* is not particularly limited, but it can also be configured to be changeable, as required.

Non-long sheets are stacked on the lift plate 507*a*. The lift plate 507*a* is singly capable of stacking e.g. approximately 3000 sheets. Long sheets longer than a predetermined length are stacked such that they extend over the lift plate 507*a* and the lift plate 507*b*. A sheet stacking surface is thus formed by the two lift plates 507*a* and 507*b*, and hence the user can easily switch between a state in which a large number of non-long sheets are stacked and a state in which long sheets are stacked.

A sheet partition plate 500 is disposed perpendicular to the lift plate 507*a* and the lift plate 507*b*, and also movable along sheet stacking surfaces of the lift plate 507*a* and the lift plate 507*b*. The sheet partition plate 500 is for restricting the trailing edge of sheets S in the sheet feeding direction, and is movable in a left-right direction, as viewed in FIG. 2. The user manually moves the sheet partition plate 500 according to the size of stacked sheets. In a case where long sheets are used, the user moves the sheet partition plate 500 to a position which corresponds to the position of the trailing edges of long sheets stacked on the lift plate 507*a* and the lift plate 507*b*.

A partition plate position sensor 606 is provided substantially in the center of the bottom of the sheet storage 506. The partition plate position sensor 606 is turned on when the sheet partition plate 500 is detected. The partition plate position sensor 606 is turned on by the movement of the sheet partition plate 500 to the lift plate 507*b*, whereby it is known that the trailing edge of sheets S which the user intends to use has reached the lift plate 507*b*, in other words, that the user intends to use long sheets.

A sheet storage section is formed above the lift plates 507*a* and 507*b*, and a sheet sensor 601 and a sheet feed position sensor 602 are disposed in the uppermost part of the sheet storage section. The sheet sensor 601 detects whether or not there is any sheet S on the lift plate 507*a*. If any sheet S is detected, the sheet sensor 601 is turned on, whereas if no sheet S is detected, the sheet sensor 601 is turned off.

The sheet feed position sensor 602 detects the uppermost surface of sheets S on the lift plate 507*a*. With this, it is determined whether or not the uppermost surface of sheets S stacked on the lift plate 507*a* is at a position where a sheet can be fed by a sheet feed pickup roller 501. During image forming operation, the CPU 301 monitors the sheet feed position sensor 602. In a case where the sheet feed position sensor 602 is turned off, the CPU 301 drives the lifter motor M500 until the sheet feed position sensor 602 is turned on, whereby the top surface of sheets S stacked on the lift plate 507*a* is controlled to be maintained at a fixed level.

The deck supply path 132 formed on the top of the sheet storage 506 is provided with the sheet feed pickup roller 501, a sheet feed roller 502, and a retard roller 503 opposed to the sheet feed roller 502. Further, the deck supply path 132 is provided with a conveying roller pair 504 and a sheet feed sensor 603. Sheets S stacked on the lift plate 507*a* or on the lift plates 507*a* and 507*b* are conveyed, one by one, to the supply path 131 of the printer 100A via the deck supply path 132. At this time, the sheet feed pickup roller 501 feeds sheets S on the lift plate 507*a*. The retard roller 503 separates a single uppermost one of sheets S to be fed, from the others.

A lift level sensor 605 is provided at a side of the sheet storage 506, which is close to the lift plate 507*a* and opposed to the mechanical stopper 609, and at the same level as the mechanical stopper 609. The lift level sensor 605 monitors the lift plate 507*a*, and when the lift plate 507*a* is detected, the lift level sensor 605 is turned on, whereas when the lift plate 507*a* is not detected, it is turned off. That is, when the lift level sensor 605 is turned on from off, the lift plate 507*a* is at the long sheet lower limit position (predetermined position).

As described hereinabove, the lift level sensor 605 is disposed at the side of the sheet storage 506, which is close to the lift plate 507*a*, and the extension lifter HP sensor 607 is disposed at the side of the same, which is close to the lift plate 507*b*. In a case where both the lift level sensor 605 and the extension lifter HP sensor 607 are on in a state where no sheets S are stored in the sheet storage 506, the lift plate 507*a* is located at the same level as that of the lift plate 507*b*, and the lift plates 507*a* and 507*b* form the same sheet stacking surface. By positioning the lift plate 507*a* and the lift plate 507*b* at the same level, the lift plates 507*a* and 507*b* are ready for having long sheets stacked thereon. On the other hand, in a case where the lift level sensor 605 is off, and the extension lifter HP sensor 607 is on, the lift plate 507*a* is located below the lift plate 507*b*. In this case, there is a level difference between the lift plate 507*a* and the lift plate 507*b*, and the lift plates 507*a* and 507*b* are in a state in which no long sheets can be stacked thereon.

A bottom position sensor 604 is provided on the bottom of the sheet storage 506. The bottom position sensor 604 is turned on if the lift plate 507*a* is on the bottom of the sheet storage 506, and is turned off if the lift plate 507*a* is not on the bottom of the sheet storage 506.

Further, the sheet storage 506 is configured such that it can be drawn out toward the near side, as viewed in FIG. 2. The sheet storage 506 is provided with a storage open button 510, and when the user presses the storage open button 510, the fixed state of the sheet feeding deck 250 and the sheet storage 506 is released. That is, a storage latch member, not shown, is released, thereby making it possible to draw the sheet storage 506 toward the near side. The sheet storage 506 is provided with a storage opening/closing sensor 608. The storage opening/closing sensor 608 detects whether or not the sheet storage 506 is in a state drawn toward the near side. If the sheet storage 506 is drawn toward the near side, the storage opening/closing sensor 608 is turned on, whereas if the sheet storage 506 is not drawn toward the near side, in other words, if the sheet storage 506 is received in the casing 250A, the storage opening/closing sensor 608 is turned off.

Next, a description will be given of the control configuration of the image forming apparatus 100 including the sheet feeding deck 250 configured as above.

Figure 3:
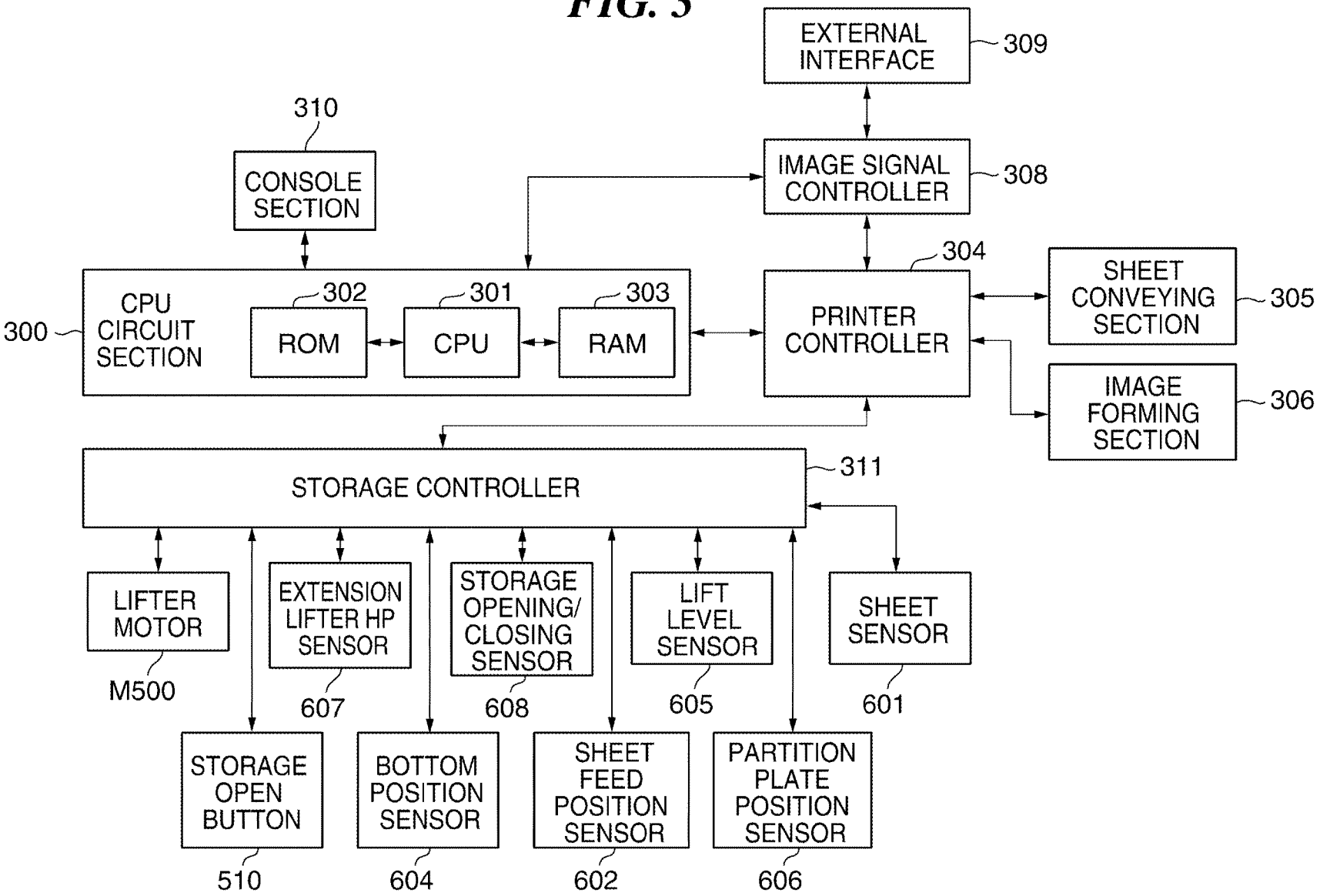
FIG. 3 is a control block diagram of the image forming apparatus.

FIG. 3 is a control block diagram of the image forming apparatus 100 shown in FIG. 1. Referring to FIG. 3, the image forming apparatus 100 includes a CPU circuit section 300. The CPU circuit section 300 incorporates the CPU 301, a ROM 302, and a RAM 303. The CPU 301 is connected to the ROM 302 and the RAM 303 by an address bus and a data bus.

The CPU circuit section 300 is connected to a console section 310 and a printer controller 304. The printer controller 304 is connected to an image signal controller 308, and an external interface 309 via the image signal controller 308. Further, the printer controller 304 is connected to the sheet conveying section 305, an image forming section 306, and a storage controller 311, respectively. Note that the image signal controller 308 is also directly connected to the CPU circuit section 300.

The storage controller 311 is connected to the lifter motor M500, the storage open button 510, the extension lifter HP sensor 607, the bottom position sensor 604, the storage opening/closing sensor 608, and the sheet feed position sensor 602, respectively. Further, the storage controller 311 is connected to the sheet sensor 601, the lift level sensor 605 and the partition plate position sensor 606.

The CPU 301 controls the overall operation of the image forming apparatus 100. The ROM 302 stores control programs. Data used for control is written in the RAM 303. The printer controller 304 instructs the image forming section 306 to form an image, based on instructions from the CPU 301. The image forming section 306 forms the image based on input video signals. Further, the printer controller 304 controls the sheet conveying section 305 to perform feeding, conveying, and so forth of sheets, based on instructions from the CPU 301. During printing operation, the image signal controller 308 performs various kinds of processing on digital image signals input via the external interface 309, converts the processed digital image signals to video signals, and stores the video signals in the RAM 303. The console section 310 receives user's instructions for selection of a color mode, input of sheet information, start of copying, and so forth, before starting image formation, and further displays a state of the image forming apparatus, warning messages, etc.

The storage controller 311 receives information from the extension lifter HP sensor 607, the storage opening/closing sensor 608, the lift level sensor 605, the storage open button 510, the bottom position sensor 604, the sheet sensor 601 and the sheet feed position sensor 602. Then, the storage controller 311 controls the lifter motor M500 based on instructions from the CPU 301.

Next, a description will be given of the operation of the image forming apparatus 100 including the sheet feeding deck 250 configured as above.

When a print job for supplying sheets from the sheet feeding deck 250 to the printer 100A is started, the lifter motor M500 rotates the wire pulley 530*c* to wind the wire 530*a* around the wire pulley 530*c*, whereby the lift plate 507*a* is lifted up. Further, a sheet feed motor, not shown, is operated which serves as the drive sources of the sheet feed pickup roller 501 and the sheet feed roller 502. With this, the sheet feed pickup roller 501, the sheet feed roller 502, and the conveying roller pair 504 are rotated, whereby sheets S placed on the lift plate 507*a* are conveyed one by one into the supply path 131 via the deck supply path 132.

At this time, if two or more sheets S are fed by the sheet feed pickup roller 501, and are caught in a separation nip formed by the sheet feed roller 502 and the retard roller 503, a second sheet S and following sheets, if any, are blocked by the retard roller 503. As a consequence, only a first and uppermost sheet S is conveyed toward the conveying roller pair 504. It is monitored by the sheet feed sensor 603 whether or not the operation for feeding the sheets S has been normally performed.

The sheet S having been conveyed into the supply path 131 is conveyed to the secondary transfer section Te by the conveying roller pairs 154 and 155, etc. The registration sensor 160 monitors for arrival of the sheet S at the secondary transfer section Te. Further, the size of the sheet S is determined based on the signals indicative of detection of the leading edge and the trailing edge of the sheet S by the registration sensor 160 or based on a sheet size input by the user via the console section 310.

In the image forming stations Y to K of the process unit 120, after the surfaces of the photosensitive drums are uniformly charged, electrostatic latent images are formed on the photosensitive drums by laser light irradiated from the scanner units 122. The electrostatic latent images formed on the photosensitive drums are developed with toners by the developing devices. Through application of a primary transfer voltage to each of the primary transfer sections Ty to Tk, toner images formed by developing the electrostatic latent images are sequentially transferred onto the intermediate transfer belt 130, whereby a color image is formed. The color image formed on the intermediate transfer belt 130 is moved to the secondary transfer section Te by rotation of the intermediate transfer belt 130.

On the other hand, the sheet S which has been brought into abutment with the registration roller 161 and stopped after the leading edge thereof was detected by the registration sensor 160 is conveyed by a predetermined amount with the leading edge held in abutment with the registration roller 161. This bends the sheet S, and thereby corrects a skew of the sheet S. The sheet S having the skew corrected is conveyed by the registration roller 161 such that the leading edge of the sheet S and the leading edge of a toner image on the intermediate transfer belt 130 meet at the secondary transfer section Te.

A transfer voltage is applied from the secondary transfer roller 404 to the sheet S which has reached the secondary transfer section Te and the color image on the intermediate transfer belt 130. With this, the color image is transferred to the sheet S. The sheet S having the color image transferred thereon is conveyed to the fixing device 170. The sheet S conveyed to the fixing device 170 is heated and pressurized by the heating roller 410 and the pressing roller 411, whereby the toner image is fixed on the sheet S. The sheet S having the color image fixed thereon is conveyed toward an discharge port of the printer 100A.

Note that when the leading edge of the sheet S having the color image transferred thereon reaches a sheet conveyance sensor 171 disposed upstream of the fixing device 170, control is started so as to convey the sheet S into to the inversion path 230 or the discharge path 231 according to a conveying destination of the sheet S, which is set in advance. In a case where front-side printing has been performed in a double-sided printing job, the sheet S is conveyed into the inversion path 230, whereas in the case of a single-sided printing job or in a case where reverse-side printing has been performed in the double-sided printing job, the sheet S is conveyed into the discharge path 231.

Hereinafter, a description will be given of the case where the sheet S having the color image fixed thereon is conveyed into the discharge path 231 in the single-sided printing job or when reverse-side printing has been performed in the double-sided printing job.

The sheet S conveyed into the discharge path 231 is conveyed by a conveying roller pair 232, and is conveyed into the lower discharge path 180 or the upper discharge path 181 by switching the inversion flapper 190 according to an instruction set in advance. In a case where a designated discharge destination is the lower discharge tray 200, the sheet S is conveyed into the lower discharge path 180, and in a case where the designated discharge destination is the upper discharge tray 196, the sheet S is conveyed into the upper discharge path 181.

Next, a description will be given of a lift plate moving process performed when the sheet storage 506 of the sheet feeding deck 250 is opened and closed.

Figure 4:
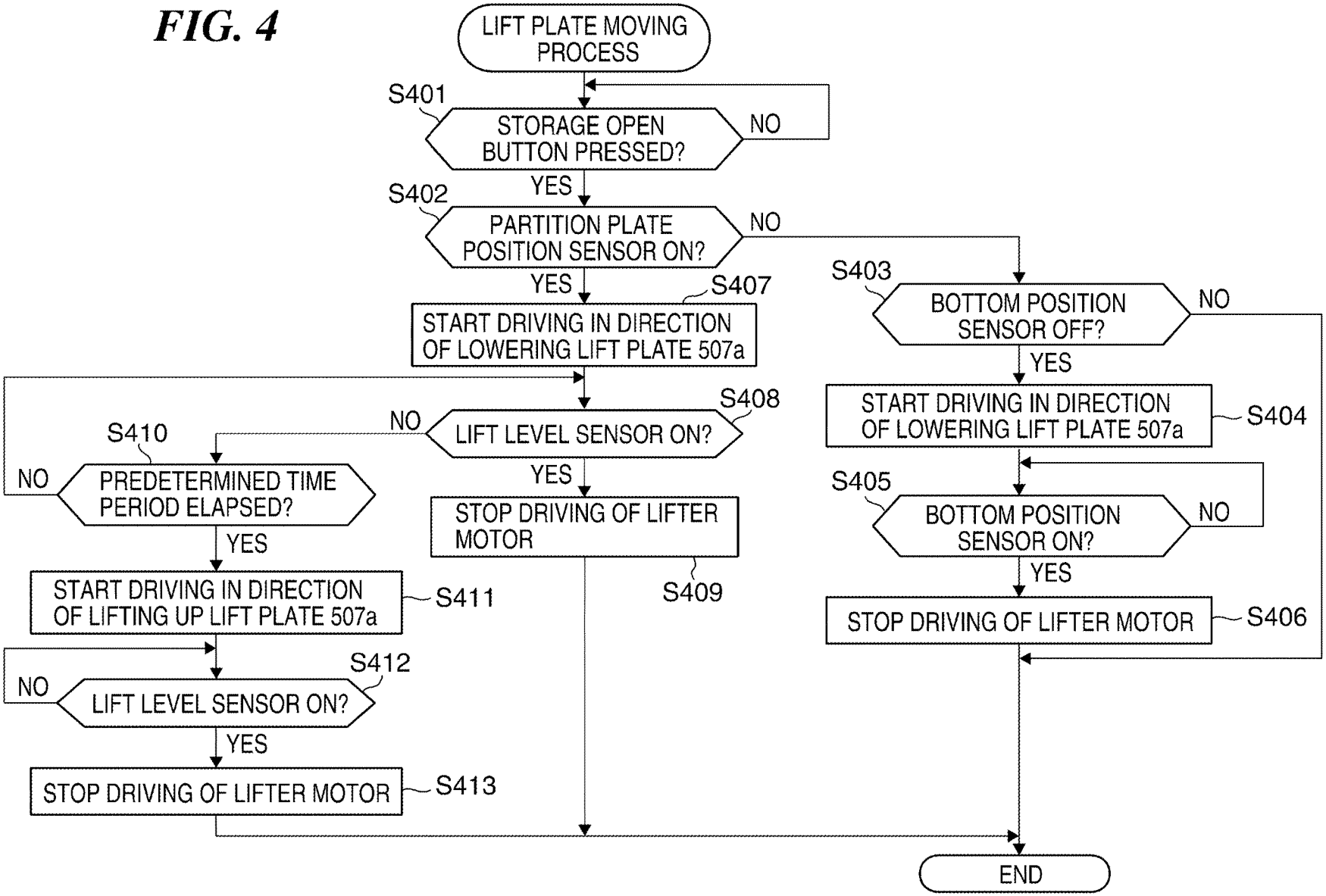
FIG. 4 is a flowchart of a lift plate moving process performed when a sheet storage is opened.

FIG. 4 is a flowchart of the lift plate moving process performed when the sheet storage is opened. This lift plate moving process is performed when the storage open button 510 has been pressed, and is executed by the CPU 301 of the CPU circuit section 300 according to a lift plate moving process program stored in the ROM 302.

Referring to FIG. 4, after the sheet feeding deck 250 is powered on, the CPU 301 always determines whether or not the storage open button 510 has been pressed (step S401), and waits until the storage open button 510 is pressed. If it is determined in the step S401 that the storage open button 510 has been pressed (YES to the step S401), the CPU 301 proceeds to a step S402, wherein the CPU 301 determines whether or not the partition plate position sensor 606 has detected the sheet partition plate 500 (step S402). If the partition plate position sensor 606 detects the sheet partition plate 500, it means that the sheet partition plate 500 has been moved to the lift plate 507*b*, i.e. that an operation concerning the storage of long sheets has been performed, and it is supposed that long sheets are to be stored. If it is determined in the step S402 that the partition plate position sensor 606 has not detected the sheet partition plate 500 (NO to the step S402), the CPU 301 proceeds to a step S403. In this case, it is not supposed that long sheets are to be stored, but it is supposed that non-long sheets are to be stored. Therefore, the CPU 301 determines whether or not the bottom position sensor 604 is off, in order to lower the lift plate 507*a* below the long sheet lower limit position (step S403).

If it is determined in the step S403 that the bottom position sensor 604 is off (YES to the step S403), the lift plate 507*a* is not at the bottom position of the sheet storage 506. Therefore, the CPU 301 controls the lifter motor M500 to start driving in a direction of lowering the lift plate 507*a* (step S404). After causing the lifter motor M500 to start lowering the lift plate 507*a*, the CPU 301 determines again whether or not the bottom position sensor 604 is turned on (step S405), and continues to lower the lift plate 507*a* until the bottom position sensor 604 is turned on. Then, after the bottom position sensor 604 is turned on (YES to the step S405), the CPU 301 stops the driving of the lifter motor M500 (step S406), followed by terminating the present process.

If the bottom position sensor 604 is turned on, it indicates that the lift plate 507*a* has reached the bottom of the sheet storage 506, and it is impossible to further lower the lift plate 507*a*. Therefore, the CPU 301 stops the driving of the lifter motor M500 for lowering the lift plate 507*a*. With this flow of operations, when the sheet storage 506 is opened by the user, the lift plate 507*a* moves downward in the sheet storage 506, and stops at the bottom position, whereby the lift plate 507*a* is ready for the user to stack non-long sheets thereon.

Note that if it is determined in the step S403 that the bottom position sensor 604 is on (NO to the step S403), there is no need to lower the lift plate 507*a*, and hence the CPU 301 immediately terminates the present process. In this case, the lift plate 507*a* is already ready for the user to stack non-long sheets on the lift plate 507*a*.

On the other hand, if it is determined in the step S402 that the partition plate position sensor 606 is on (YES to the step S402), it is supposed in this case that long sheets are to be stored, and hence the CPU 301 proceeds to a step S407, wherein the CPU 301 controls the lifter motor M500 to start driving in the direction of lowering the lift plate 507*a* (step S407). After causing the lifter motor M500 to start to lower the lift plate 507*a*, the CPU 301 determines whether or not the lift level sensor 605 is turned on (step S408). If it is determined in the step S408 that the lift level sensor 605 is turned on (YES to the step S408), the CPU 301 stops the driving of the lifter motor M500 (step S409), followed by terminating the present process. At this time, the lift plate 507*a* is at the level of the lift level sensor 605, and the lift plate 507*b* as well is at the level of the extension lifter HP sensor 607, which is at the same level as that of the lift level sensor 605. In this state, the lift plate 507*a* and the lift plate 507*b* are located at the same level, and they are in a state ready for stacking long sheets.

On the other hand, if it is determined in the step S408 that the lift level sensor 605 is not turned on (NO to the step S408), the CPU 301 continues to lower the lift plate 507*a*, and then determines whether or not a predetermined time period has elapsed (step S410). The predetermined time period is a time period long enough for the lift plate 507*a*, which is located above the lift level sensor 605, to be lowered to the position of the lift level sensor 605.

If it is determined in the step S410 that the predetermined time period has not elapsed (NO to the step S410), the CPU 301 returns to the step S408, and waits until the lift level sensor 605 is turned on. On the other hand, if it is determined in the step S410 that the predetermined time period has elapsed (YES to the step S410), the CPU 301 controls the lifter motor M500 to stop lowering the lift plate 507*a*, and start driving in a direction of lifting up the lift plate 507*a* (step S411). If the lift level sensor 605 is not turned on even when the predetermined time period has elapsed (NO to the step S408), it is considered that the lift plate 507*a* is located below the lift level sensor 605. Note that in this case, the lift plate 507*b* is stationary at the position of the extension lifter HP sensor 607, which is the HP. Therefore, in this case, the CPU 301 causes the lift plate 507*a* to be lifted to the position of the lift level sensor 605.

Then, the CPU 301 determines whether or not the lift level sensor 605 is turned on (step S412), and continues the driving of the lifter motor M500 in the direction of lifting up the lift plate 507*a* until the lift level sensor 605 is turned on. Then, when the lift level sensor 605 has been turned on (YES to the step S412), the CPU 301 stops the driving of the lifter motor M500 (step S413), followed by terminating the present process. In this state, the lift plate 507*a* and the lift plate 507*b* are located at the same level, and they are in a state ready for stacking long sheets.

After termination of the lift plate moving process shown in FIG. 4, the sheet storage 506 is opened, whereby the user is enabled to draw out the sheet storage 506.

According to the process in FIG. 4, in a case where the storage open button 510 is pressed and not long sheets but non-long sheets are supposed to be used (NO to the step S402), the lift plate 507*a* is moved to the bottom of the sheet storage 506 (steps S404 and S406). This makes the lift plate 507*a* ready for stacking non-long sheets thereon, and hence operability is improved.

On the other hand, in a case where the storage open button 510 is pressed and long sheets are supposed to be used (YES to the step S402), the lift plate 507*a* and the lift plate 507*b* are moved to the level of the HP of the lift plate 507*b* and stopped (steps S408 and S409, and steps S412 and S413). This makes the lift plates 507*a* and 507*b* ready for stacking long sheets thereon, and hence operability is improved when non-long sheets and long sheets are switchingly used.

Next, a description will be given of the lift plate moving process performed when the sheet storage is closed.

Figure 5:
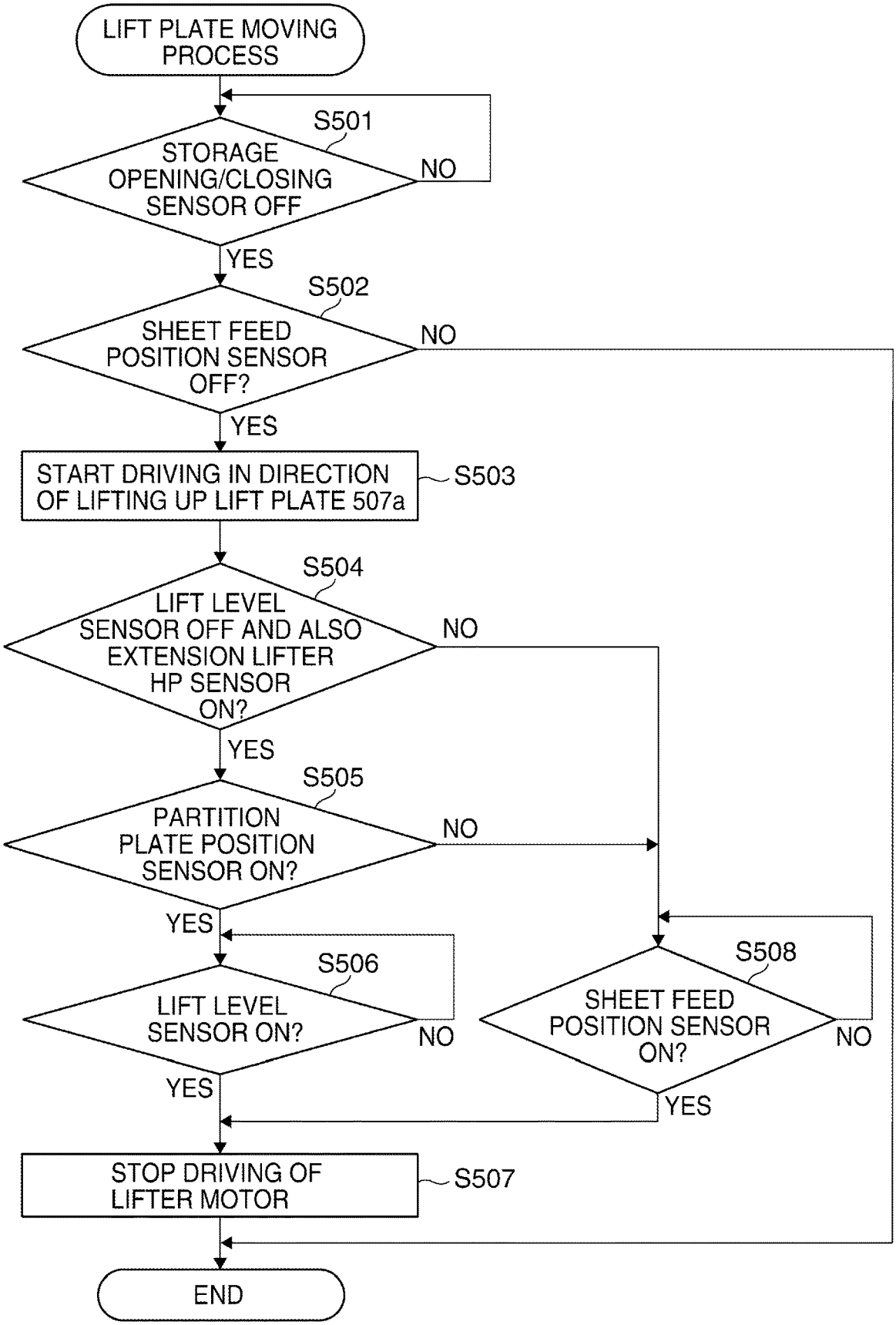
FIG. 5 is a flowchart of a lift plate moving process performed when the sheet storage is closed.

FIG. 5 is a flowchart of the lift plate moving process performed when the sheet storage is closed. This lift plate moving process is performed when the user, who is about to perform image formation using e.g. long sheets, closes the sheet storage after removing non-long sheets stored in the sheet storage 506, and moving the sheet partition plate 500 to the lift plate 507*b*. The lift plate moving process is executed by the CPU 301 of the CPU circuit section 300 according to a lift plate moving process program stored in the ROM 302.

Referring to FIG. 5, after the sheet feeding 250 is powered on, and the lift plate moving process is started, the CPU 301 monitors whether or not the storage opening/closing sensor 608 is off, i.e. whether or not the sheet storage 506 is in a closed state (step S501). Then, the CPU 301 waits until the sheet storage 506 is closed. If it is determined in the step S501 that the sheet storage 506 is in the closed state (YES to the step S501), the CPU 301 proceeds to a step S502, wherein the CPU 301 determines whether or not the sheet feed position sensor 602 is off, in other words, whether or not the lift plate 507*a* is not in a sheet feed-enabled state in which the lift plate 507*a* is in the uppermost part of the sheet storage section (step S502). If it is determined in the step S502 that the sheet feed position sensor 602 is off, i.e. if the lift plate 507*a* is not in the sheet feed-enabled state (YES to the step S502), the CPU 301 proceeds to a step S503, to control the lifter motor M500 to start driving in the direction of lifting up the lift plate 507*a* (step S503).

After causing the lifter motor M500 to start lifting up the lift plate 507*a* (step S503), the CPU 301 determines whether or not the lift level sensor 605 is off, and also the extension lifter HP sensor 607 is on (step S504). By thus determining the on/off of the lift level sensor 605 and the extension lifter HP sensor 607, it is possible to determine whether or not the lift plate 507*a* is positioned lower than the HP, which is the lifting down limit position (long sheet lower limit position), of the lift plate 507*b*. More specifically, if the conditions of the step S504 are satisfied, the lift plate 507*a* is lower than the HP of the lift plate 507*b*, but if the conditions of the step S504 are not satisfied, the lift plate 507*a* and the lift plate 507*b* are positioned at the same level, i.e. or lift plate 507*a* and the lift plate 507*b* are positioned at the level of the HP of the lift plate 507*b* or higher than the same.

If it is determined in the step S504 that the conditions are satisfied, i.e. if the lift plate 507*a* is lower than the HP of the lift plate 507*b* (YES to the step S504), the CPU 301 proceeds to a step S505 to determine whether or not the partition plate position sensor 606 is on, in other words, whether or not long sheets are going to be used (step S505). If the sheet partition plate 500 has been moved to a position corresponding to the sheet stacking surface of the lift plate 507*b*, it is supposed that the user is about to use long sheets stacked to extend over the lift plate 507*a* and the lift plate 507*b*. Therefore, if it is determined in the step S505 that the partition plate position sensor 606 is on (YES to the step S505), the CPU 301 proceeds to a step S506.

More specifically, the CPU 301 determines whether or not the lift level sensor 605 is turned on, and continues to lift up the lift plate 507*a* until the lift level sensor 605 is turned on (step S506). Then, after the lift plate 507*a* is lifted up to the position of the lift level sensor 605, causing the lift level sensor 605 to be turned on (YES to the step S506), the CPU 301 stops the driving of the lifter motor M500 (step S507), followed by terminating the present process.

By lifting up the lift plate 507*a* until the lift level sensor 605 is turned on, the level of the lift plate 507*a* and that of the lift plate 507*b* match each other at the position of the lift level sensor 605, i.e. the position of the extension lifter HP sensor 607. With this, in a case where the user is supposed to stack long sheets and also the sheet storage 506 is temporarily closed, the lift plate 507*a* and the lift plate 507*b* are controlled such that the levels thereof match each other, whereby the lift plates 507*a* and 507*b* are ready for stacking long sheets.

On the other hand, if it is determined in the step S504 that the conditions are not satisfied (NO to the step S504), the CPU 301 proceeds to a step S508. In this case, the lift plate 507*a* and the lift plate 507*b* are in a state positioned at the same level, there is no need to adjust the levels of the two lift plates. Therefore, in the step S508, the lift plates 507*a* and 507*b* are directly subjected to processing for making them ready for feeding sheets S. More specifically, the CPU 301 causes the lift plates 507*a* and 507*b* to be lifted up until the sheet feed position sensor 602 is turned on (YES to the step S508), to thereby place the lift plates 507*a* and 507*b* in a state enabled to feed long sheets.

Further, if it is determined in the step S505 that the condition mentioned therein is not satisfied (NO to the step S505), the CPU 301 proceeds to the step S508. In this case, it is supposed that the user is not going to use long sheets. Therefore, in the step S508, the CPU 301 causes the lift plate 507*a* to be lifted up until the sheet feed position sensor 602 is turned on (YES to the step S508), to thereby place the lift plate 507*a* in a state enabled to feed non-long sheets. Then, the CPU 301 stops the driving of the lifter motor M500 (step S507), followed by terminating the present process.

Further, if it is determined in the step S502 that the sheet feed position sensor 602 is on (NO to the step S502), the lift plate 507*a* is in the sheet feed-enabled state and the lift plate 507*a* cannot be lifted up any further, so that the CPU 301 terminates the present lift plate moving process.

According to the process in FIG. 5, in a case where the sheet storage 506 is closed, the CPU 301 determines whether or not the lift plate 507*a* and the lift plate 507*b* are positioned at the same level (step S504). In a case where the lift plate 507*a* and the lift plate 507*b* are not positioned at the same level, and also in a case where long sheets are supposed to be used (YES to the step S505), the CPU 301 causes the lift plate 507*a* to be lifted up to thereby adjust the lift plate 507*a* to the same level as the lift plate 507*b* (steps S506 and 507). With this, after opening the sheet storage 506 and then moving the sheet partition plate 500 to the position corresponding to the lift plate 507*b*, the user only closes the sheet storage 506, whereby the lift plates 507*a* and 507*b* become ready for storing long sheets thereon. This improves operability when long sheets are used, whereby even in a case where non-long sheets and long sheets are switchingly used, it is possible to improve the user-friendliness of the sheet feeding deck 250.

Note that in the present embodiment, after the lift plate moving process in FIG. 5 is once performed to make the lift plates 507*a* and 507*b* ready for stacking long sheets thereon, even if the sheet storage 506 is opened in order to stack the long sheets, the lift plate moving (lowering) process in FIG. 4 is subjected to control such that it is not executed in this case. This makes it possible to maintain the state of the sheet storage 506 once made ready for stacking long sheets, without requiring any adjustment. The above-mentioned control may be realized by adding a step for determination of the above-mentioned state, to the start of the lift plate moving process in FIG. 4.

In the present embodiment, the user may set a size of sheets to be stored in the sheet storage 506 using the console section 310, and the CUP can determine, based on the set size, that the user is going to store long sheets in the sheet storage 506.

In the present embodiment, in a case where image formation is to be performed using non-long sheets after performing image formation using long sheets, the user presses the storage open button 510, and after the sheet storage 506 is opened, long sheets are removed. Thereafter, the user moves the sheet partition plate 500 to the lift plate 507*a*. With this, a stored state of long sheets prepared by the lift plate moving process in FIG. 5 is released, whereby the lift plate 507*a* is lowered to the bottom position of the sheet storage. Therefore, it is possible to smoothly shift from an image forming operation using long sheets to an image forming operation using non-long sheets, and hence it is possible to improve the user's convenience when switching between sheets for use.

In the present embodiment, the lift mechanism 530 is configured such that above the long sheet lower limit position, the lift plate 507*b* is lifted up and down in accordance with the lifting (up and down motion) of the lift plate 507*a*. Further, the mechanical stopper 609 for restricting a range of lifting (down motion) of the lift plate 507*b* is provided. With this, a lift capability required of the lift mechanism 530 can be made relatively small, but not too large.

In the present embodiment, the lift plate for stacking sheets S is formed by two lift plates, and non-long sheets are stacked on the lift plate 507*a*, and long sheets are stacked to extend over the lift plate 507*a* and the lift plate 507*b*. Therefore, strength required of the lift plate 507*a* and the lift plate 507*b* can be made relatively small.

The sheet feeding device (sheet feeding deck) 250 according to the present embodiment forms an image forming system together with the image forming apparatus that forms images on sheets fed from the sheet feeding device 250.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-099931 filed May 19, 2017 which is hereby incorporated by reference herein in its entirety.

What is claimed is:

1. A sheet feeding device comprising:

a storage configured to be openable and closable, and to store sheets to be used for image formation;

a feed unit configured to feed sheets from the storage;

a first lift plate, provided in the storage so as to being capable of stacking the sheets and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate;

a opening/closing detector configured to detect opening or closing of the storage; and a controller configured to determine whether or not an operation concerning storing of the long sheets in the storage has been performed, and to control the lifter, in a case where it is determined that the operation has been performed, to match a position of the first lift plate and a position of the second lift plate by lifting up or down the first lift plate so as to be positioned same height with a home position of the second lift plate, wherein the controller controls the lifter to cause height of the first lift plate and height of the second lift plate to match each other, in a case where closing of the storage as the operation has been detected by the opening/closing detector.

2. The sheet feeding device according to claim 1, further comprising a setting unit configured to set a size of sheets, and wherein the controller determines that the operation has been performed, according to the size of sheets set by the setting unit.

3. The sheet feeding device according to claim 1, further comprising:

a restriction member configured to restrict a position of a trailing edge of the sheet stored in the storage; and a sensor configured to detect that the restriction member is at a position corresponding to the long sheet, wherein the controller determines that the operation has been performed in a case where the sensor detects that the restriction member is moved to the position corresponding to the long sheet.

4. A sheet feeding device comprising:

a storage configured to be openable and closable, and to store sheets to be used for image formation;

a feed unit configured to feed sheets from the storage;

a first lift plate, provided in the storage so as to being capable of stacking the sheets and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate;

a height detector configured to detect whether the first lift plate is at the same height of the home position of the second lift plate; and a controller configured to determine whether or not an operation concerning storing of the long sheets in the storage has been performed, and to control the lifter, in a case where it is determined that the operation has been performed, to match a position of the first lift plate and a position of the second lift plate by lifting up or down the first lift plate so as to be positioned same height with a home position of the second lift plate;

wherein the controller controls the lifter so as to being capable of detecting that the first lift plate is positioned at the same height of the home position of the second lift plate.

5. The sheet feeding device according to claim 4, further comprising:

a restriction member configured to restrict a position of a trailing edge of the sheet stored in the storage; and a sensor configured to detect that the restriction member is at a position corresponding to the long sheet, wherein the controller determines that the operation has been performed in a case where the sensor detects that the restriction member is moved to the position corresponding to the long sheet.

6. The sheet feeding device according to claim 4, further comprising a setting unit configured to set a size of sheets, and wherein the controller determines that the operation has been performed, according to the size of sheets set by the setting unit.

7. A sheet feeding device comprising:

a storage configured to be openable and closable, and to store sheets to be used for image formation;

a feed unit configured to feed sheets from the storage;

a first lift plate, provided in the storage so as to being capable of stacking the sheets and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate;

a sheet partition plate configured to be movable in the sheet feeding direction in parallel to sheet stacking surfaces of the first lift plate and the second lift plate in the storage; and a controller configured to determine whether or not an operation concerning storing of the long sheets in the storage has been performed, and to control the lifter, in a case where it is determined that the operation has been performed, to match a position of the first lift plate and a position of the second lift plate by lifting up or down the first lift plate so as to be positioned same height with a home position of the second lift plate;

wherein the controller determines that the operation has been performed, in a case where the sheet partition plate is at a position corresponding to the long sheets.

8. The sheet feeding device according to claim 7, further comprising:

a restriction member configured to restrict a position of a trailing edge of the sheet stored in the storage; and a sensor configured to detect that the restriction member is at a position corresponding to the long sheet, wherein the controller determines that the operation has been performed in a case where the sensor detects that the restriction member is moved to the position corresponding to the long sheet.

9. The sheet feeding device according to claim 7, further comprising a setting unit configured to set a size of sheets, and wherein the controller determines that the operation has been performed, according to the size of sheets set by the setting unit.

10. A sheet feeding device comprising:

a storage configured to be openable and closable, and to store sheets to be used for image formation;

a feed unit configured to feed sheets from the storage;

a first lift plate, provided in the storage so as to being capable of stacking the sheets and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate; and a controller configured to determine whether or not an operation concerning storing of the long sheets in the storage has been performed, and to control the lifter, in a case where it is determined that the operation has been performed, to match a position of the first lift plate and a position of the second lift plate by lifting up or down the first lift plate so as to be positioned same height with a home position of the second lift plate;

wherein when the first lift plate is lifted up and down by the lifter below same height with the home position, the second lift plate stays at the home position, whereas when the first lift plate is lifted up and down above same height with the home position, the second lift plate is lifted up and down as the first lift plate is lifted up and down.

11. The sheet feeding device according to claim 10, further comprising a restriction member configured to cause the second lift plate to stay at the home position.

12. The sheet feeding device according to claim 10, further comprising a opening/closing detector configured to detect opening or closing of the storage, and wherein the controller further determines whether or not a second operation has been performed concerning storing of the non-long sheets, in the storage, and wherein the controller controls the lifter to lift down the first lift plate to a position below same height with the home position, in a case where it is determined that the second operation has been performed and opening of the storage has been detected by the opening/closing detector, whereas the controller controls the lifter to lift down the first lift plate to the predetermined position in a case where it is determined that the operation has been performed, and opening of the storage has been detected by the opening/closing detector.

13. The sheet feeding device according to claim 10, further comprising:

a restriction member configured to restrict a position of a trailing edge of the sheet stored in the storage; and a sensor configured to detect that the restriction member is at a position corresponding to the long sheet, wherein the controller determines that the operation has been performed in a case where the sensor detects that the restriction member is moved to the position corresponding to the long sheet.

14. The sheet feeding device according to claim 10, further comprising a setting unit configured to set a size of sheets, and wherein the controller determines that the operation has been performed, according to the size of sheets set by the setting unit.

15. An image forming system including:

a sheet feeding device, and an image forming apparatus that forms images on sheets fed from the sheet feeding device, wherein the sheet feeding device comprises:

a storage configured to be openable and closable, and to store sheets to be used for image formation;

a feed unit configured to feed sheets from the storage;

a first lift plate, provided in the storage so as to being capable of stacking the sheets, and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate;

a opening/closing detector configured to detect opening or closing of the storage; and a controller configured to determine whether or not an operation concerning storing of the long sheets in the storage has been performed, and to control the lifter, in a case where it is determined that the operation has been performed, to match a position of the first lift plate and a position of the second lift plate by lifting up or down the first lift plate so as to be positioned same height with a home position of the second lift plate wherein the controller controls the lifter to cause height of the first lift plate and height of the second lift plate to match each other, in a case where closing of the storage as the operation has been detected by the opening/closing detector.

16. A method of controlling a sheet feeding device, the sheet feeding comprising:

a storage configured to be openable and closable, and to store sheets to be used for image formation;

a feed unit configured to feed sheets from the storage;

a first lift plate, provided in the storage so as to being capable of stacking the sheets, and configured to be capable of being lifted up and down;

a lifter configured to lift up and down the first lift plate;

a second lift plate, provided in the storage, side by side with the first lift plate in a sheet feeding direction, and configured to be lifted up and down in accordance with lifting up and down of the first lift plate but not be lifted up and down independently, non-long sheets shorter than or equal to a predetermined length in the sheet feeding direction being stacked on the first lift plate but not being stacked on the second lift plate, and long sheets longer than the predetermined length in the sheet feeding direction being stacked on extending over the first lift plate and the second lift plate; and a opening/closing detector configured to detect opening or closing of the storage, the method comprising:

determining whether or not an operation concerning storing of the long sheets in the storage has been performed; and controlling the lifter, in a case where it is determined that the operation has been performed, to match a position of the first lift plate and a position of the second lift plate by lifting up or down the first lift plate so as to be positioned same height with a home position of the second lift plate, and controlling the lifter to cause height of the first lift plate and height of the second lift plate to match each other, in a case where closing of the storage as the operation has been detected by the opening/closing detector.

* * * * *